US012680717B2

(12) United States Patent
Boyd et al.

(10) Patent No.: US 12,680,717 B2
(45) Date of Patent: Jul. 14, 2026

(54) SYSTEMS AND METHODS FOR OPERATING AN HVAC SYSTEM

(71) Applicant: Johnson Controls Tyco IP Holdings LLP, Milwaukee, WI (US)

(72) Inventors: Andrew Michael Boyd, Wichita, KS (US); Jeremy Ryan Smith, Park City, KS (US); Steven A. Tice, Wichita, KS (US); Mason Sloan DeWald, Wichita, KS (US)

(73) Assignee: Johnson Controls Light Commercial IP GmbH, Shaffhausen (CH)

( * ) Notice: Subject to any disclaimer, the term of this patent is extended or adjusted under 35 U.S.C. 154(b) by 408 days.

(21) Appl. No.: 18/210,735

(22) Filed: Jun. 16, 2023

(65) Prior Publication Data

US 2023/0408130 A1 Dec. 21, 2023

Related U.S. Application Data

(60) Provisional application No. 63/353,258, filed on Jun. 17, 2022.

(51) Int. Cl.
*F24F 11/65* (2018.01)
*F24F 11/74* (2018.01)
(Continued)

(52) U.S. Cl.
CPC ..... *F24F 11/65* (2018.01); *F24F 11/74* (2018.01); *F24F 2110/10* (2018.01); *F24F 2110/40* (2018.01)

(58) Field of Classification Search
CPC ..... F24F 11/65; F24F 11/74; F24F 2110/10; F24F 2110/40; F24F 2140/20;
(Continued)

(56) References Cited

U.S. PATENT DOCUMENTS

2008/0195237 A1* 8/2008 Mukaigawa ..... G06Q 10/06 700/90
2015/0252653 A1* 9/2015 Shelton, Jr. ..... E21B 4/006 165/45
(Continued)

*Primary Examiner* — Alicia M. Choi
(74) *Attorney, Agent, or Firm* — Jeremy Hargis

(57) ABSTRACT

A heating, ventilation, and air conditioning (HVAC) system includes a heat exchanger configured to receive a working fluid and place the working fluid in a heat exchange relationship with an air flow directed across the heat exchanger, a switch configured to detect an operating parameter of the HVAC system, where the switch is configured to interrupt operation of the HVAC system in response to detection of a first value of the operating parameter greater than an operating parameter limit value, and a sensor configured to detect the operating parameter of the HVAC system. The HVAC system also includes a controller communicatively coupled to the sensor, where the controller is configured to receive data indicative of a second value of the operating parameter, compare the second value of the operating parameter to a threshold value of the operating parameter, wherein the threshold value is less than the operating parameter limit value, and adjust operation of the HVAC system in response to a determination that the second value of the operating parameter is greater than the threshold value.

20 Claims, 7 Drawing Sheets

(51) Int. Cl.
*F24F 110/10* (2018.01)
*F24F 110/40* (2018.01)

(58) Field of Classification Search
CPC ..... F24F 11/30; F24F 2140/12; F24F 11/77; F24D 2200/123; F24D 5/02; F24D 5/12; F24D 19/1084; F24H 15/208; F24H 15/242; F24H 15/35; F24H 15/38; F25B 49/005; F25B 49/022; E21B 21/08; F17D 5/06; G01M 3/2815
See application file for complete search history.

(56) References Cited

U.S. PATENT DOCUMENTS

| | | | | |
|---|---|---|---|---|
| 2018/0045474 | A1* | 2/2018 | Yoshikawa | F24F 11/56 |
| 2018/0135869 | A1* | 5/2018 | Fard | F24D 12/02 |
| 2019/0170600 | A1* | 6/2019 | Tice | G01M 3/2815 |
| 2020/0309393 | A1* | 10/2020 | Bhosale | F24F 13/20 |
| 2020/0348087 | A1* | 11/2020 | Wilson | F24F 11/75 |
| 2021/0199325 | A1* | 7/2021 | Wu | F24F 11/64 |
| 2022/0018563 | A1* | 1/2022 | Liu | H02P 29/024 |
| 2023/0184473 | A1* | 6/2023 | Alfano | F25B 45/00 62/77 |
| 2023/0288087 | A1* | 9/2023 | Goel | F24F 11/65 |

* cited by examiner

SYSTEMS AND METHODS FOR OPERATING AN HVAC SYSTEM

CROSS REFERENCE TO RELATED APPLICATIONS

This application claims priority to and the benefit of U.S. Provisional Application No. 63/353,258, entitled "CONTROL UNIT FOR AN HVAC SYSTEM," filed Jun. 17, 2022, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties by controlling of a supply air flow delivered to a conditioned space. For example, the HVAC system may place the supply air flow in a heat exchange relationship with a refrigerant of a vapor compression circuit to condition the supply air flow before the supply air flow is delivered to the conditioned space. Some HVAC systems may include additional or alternative components configured to condition the supply air flow, such as a furnace, filters, energy recovery components, and so forth. Further, certain HVAC systems and/or HVAC system components may be configured to operate at different capacities, stages, or other variable operating levels. Unfortunately, existing HVAC systems are susceptible to operational interruptions. For example, in some instances, a pressure of the refrigerant circulated through the vapor compression circuit may rise or fall to a level that causes operational interruption of the vapor compression circuit. Similarly, a temperature of a furnace may reach or exceed a level that results in operational interruption of the furnace. In such instances, the HVAC system may be inoperable to provide conditioning to a condition space. Further, in some cases, operation of the HVAC system may be suspended until a technician services the HVAC system.

SUMMARY

In one embodiment, a heating, ventilation, and air conditioning (HVAC) system includes a heat exchanger configured to receive a working fluid and place the working fluid in a heat exchange relationship with an air flow directed across the heat exchanger, a switch configured to detect an operating parameter of the HVAC system, where the switch is configured to interrupt operation of the HVAC system in response to detection of a first value of the operating parameter greater than an operating parameter limit value, and a sensor configured to detect the operating parameter of the HVAC system. The HVAC system also includes a controller communicatively coupled to the sensor, where the controller is configured to receive data indicative of a second value of the operating parameter, compare the second value of the operating parameter to a threshold value of the operating parameter, wherein the threshold value is less than the operating parameter limit value, and adjust operation of the HVAC system in response to a determination that the second value of the operating parameter is greater than the threshold value.

In another embodiment, a control system for a heating, ventilation, and air conditioning (HVAC) system includes a sensor configured to detect an operating parameter of the HVAC system, processing circuitry, and a memory including instructions that, when executed by the processing circuitry, cause the processing circuitry to receive data indicative of a value of the operating parameter from the sensor, compare the value of the operating parameter to a threshold value of the operating parameter, where the threshold value is different from a limit value of the operating parameter that causes a switch of the HVAC system to actuate and interrupt operation of the HVAC system, and adjust operation of the HVAC system in response to a determination that the value of the operating parameter exceeds the threshold value.

In a further embodiment, a heating, ventilation, and air conditioning (HVAC) system includes a heat exchanger configured to receive a working fluid and place the working fluid in a heat exchange relationship with an air flow directed across the heat exchanger, a fan configured to direct the air flow across the heat exchanger, a switch configured to detect an operating parameter of the HVAC system, where the switch is configured to interrupt operation of the HVAC system in response to detection of a first value of the operating parameter greater than an operating parameter limit value, and a controller. The controller is configured to receive data from a sensor indicative of a second value of the operating parameter, compare the second value of the operating parameter to a threshold value of the operating parameter, where the threshold value is less than the operating parameter limit value, and adjust operation of the fan in response to a determination that the second value of the operating parameter is greater than the threshold value.

BRIEF DESCRIPTION OF THE DRAWINGS

Various aspects of this disclosure may be better understood upon reading the following detailed description and upon reference to the drawings in which.

DETAILED DESCRIPTION

Figure 1:
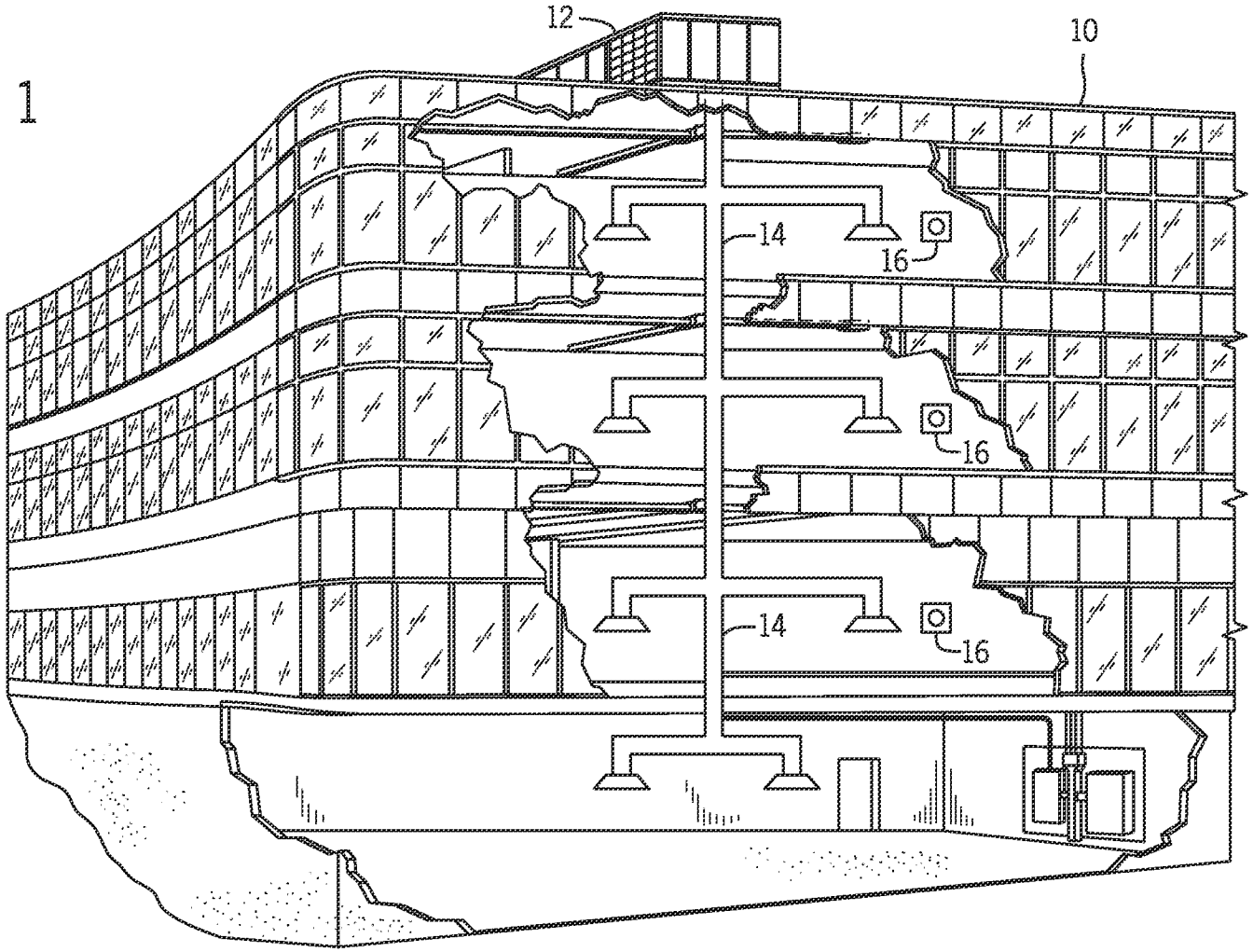
FIG. 1 is a perspective view of an embodiment of a building incorporating a heating, ventilation, and air conditioning (HVAC) system in a commercial setting, in accordance with an aspect of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

As briefly discussed above, a heating, ventilation, and air conditioning (HVAC) system may be used to thermally regulate a space within a building, home, or other suitable structure. For example, the HVAC system may include a vapor compression system that operates to transfer thermal energy between a working fluid, such as a refrigerant, and a fluid to be conditioned, such as air. The vapor compression system includes heat exchangers, such as a condenser and an evaporator, which are fluidly coupled to one another via one or more conduits of a working fluid loop or circuit. A compressor may be used to circulate the working fluid through the conduits and other components of the working fluid circuit (e.g., an expansion device) and, thus, enable the transfer of thermal energy between components of the working fluid circuit (e.g., between the condenser and the evaporator) and one or more thermal loads (e.g., an environmental air flow, a supply air flow).

In some embodiments, the HVAC system may include a heat pump (e.g., a heat pump system, a reverse-cycle heat pump) having a first heat exchanger (e.g., a heating and/or cooling coil, an indoor coil, the evaporator) positioned within or otherwise fluidly coupled to the space to be conditioned, a second heat exchanger (e.g., a heating and/or cooling coil, an outdoor coil, the condenser) positioned in or otherwise fluidly coupled to an ambient environment (e.g., the atmosphere), and a pump (e.g., the compressor) configured to circulate the working fluid (e.g., refrigerant) between the first and second heat exchangers to enable heat transfer between the thermal load and the ambient environment, for example. As will be appreciated, the heat pump system may be operable to provide both cooling or heating to the space to be conditioned (e.g., a room, zone, or other region within a building) by adjusting a flow of the working fluid through the working fluid circuit. For example, during operation of the heat pump system in a cooling mode, the compressor may direct working fluid through the working fluid circuit and the first and second heat exchangers in a first flow direction to enable cooling of an air flow (e.g., supply air flow) directed to the space. During operation of the heat pump system in a heating mode, the compressor may direct working fluid through the working fluid circuit and the first and second heat exchangers in a second flow direction, opposite the first flow direction, to enable heating of the air flow directed to the space.

In some embodiments, the HVAC system may include a furnace system configured to enable heating of an air flow directed to the space. For example, the furnace system may be configured to combust a fuel to generate combustion products. The combustion products may be directed through a heat exchanger of the furnace system to place the combustion products in a heat exchange relationship with an air flow and enable heating of the air flow, which may be directed to a conditioned space.

Unfortunately, in certain conditions, the HVAC system may be susceptible to operational interruptions. In some instances, during operation of a vapor compression circuit of the HVAC system, an operating parameter of a working fluid circulated through the vapor compression circuit may increase or decrease to a level that induces an operational interruption of the vapor compression circuit. For example, the HVAC system may include a switch (e.g., high pressure switch, low pressure switch, a "trip switch") configured to detect the operational parameter and actuate to suspend operation of the compressor of the vapor compression circuit in response to a detected value of the opening parameter reaching a threshold level (e.g., a "trip value"). Similarly, during operation of a furnace system of the HVAC system, an operating parameter of the furnace system may increase to a threshold level that induces an operational interruption of the furnace system. In some applications, the furnace system may include a switch (e.g., a high temperature switch, a "trip switch") configured to detect a temperature of a supply air flow heated by the furnace system and to interrupt operation of the furnace system upon a detected value of the temperature reaching or exceeding a threshold level. During such operational interruptions, the HVAC system may no longer operate to provide conditioned air to a conditioned space. Further, in some instances, operation of the HVAC system may remain suspended until a technician or other operator performs service or maintenance on the HVAC system.

Accordingly, embodiments of the present disclosure are directed to systems and methods that enable improved operation of HVAC systems. In particular, present embodiments include a control system configured to mitigate occurrence of operating conditions that may otherwise cause operational interruptions in existing HVAC systems. For example, the control system may include a controller and one or more sensors communicatively coupled to the controller. The one or more sensors may be configured to detect one or more operating parameters of the HVAC system. Based on data and/or feedback received from the one or more sensors, the controller may execute one or more remedial actions or operations to enable continued operation of the HVAC system to condition an air flow. For example, upon a determination that an operating parameter of the HVAC system is approaching an operating parameter limit (e.g., upper limit, lower limit, tripping set point) associated with operational interruption of the HVAC system, the controller may execute one or more remedial operations to mitigate instances of the operating parameter reaching or exceeding the operating parameter limit. As discussed in further detail below, the remedial operations may cause adjustment of the operational parameter, such that the operational parameter does not continue to approach and/or reach the operating parameter limit. In this way, operational interruptions of the HVAC system may be reduced. Therefore, the disclosed techniques enable improved operation of HVAC systems.

Turning now to the drawings, FIG. 1 illustrates an embodiment of a heating, ventilation, and air conditioning (HVAC) system for environmental management that employs one or more HVAC units in accordance with the present disclosure. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12 with a reheat system in accordance with present embodiments. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air-cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more working fluid circuits (e.g., vapor compression circuits) for cooling an air flow and a furnace for heating the air flow.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
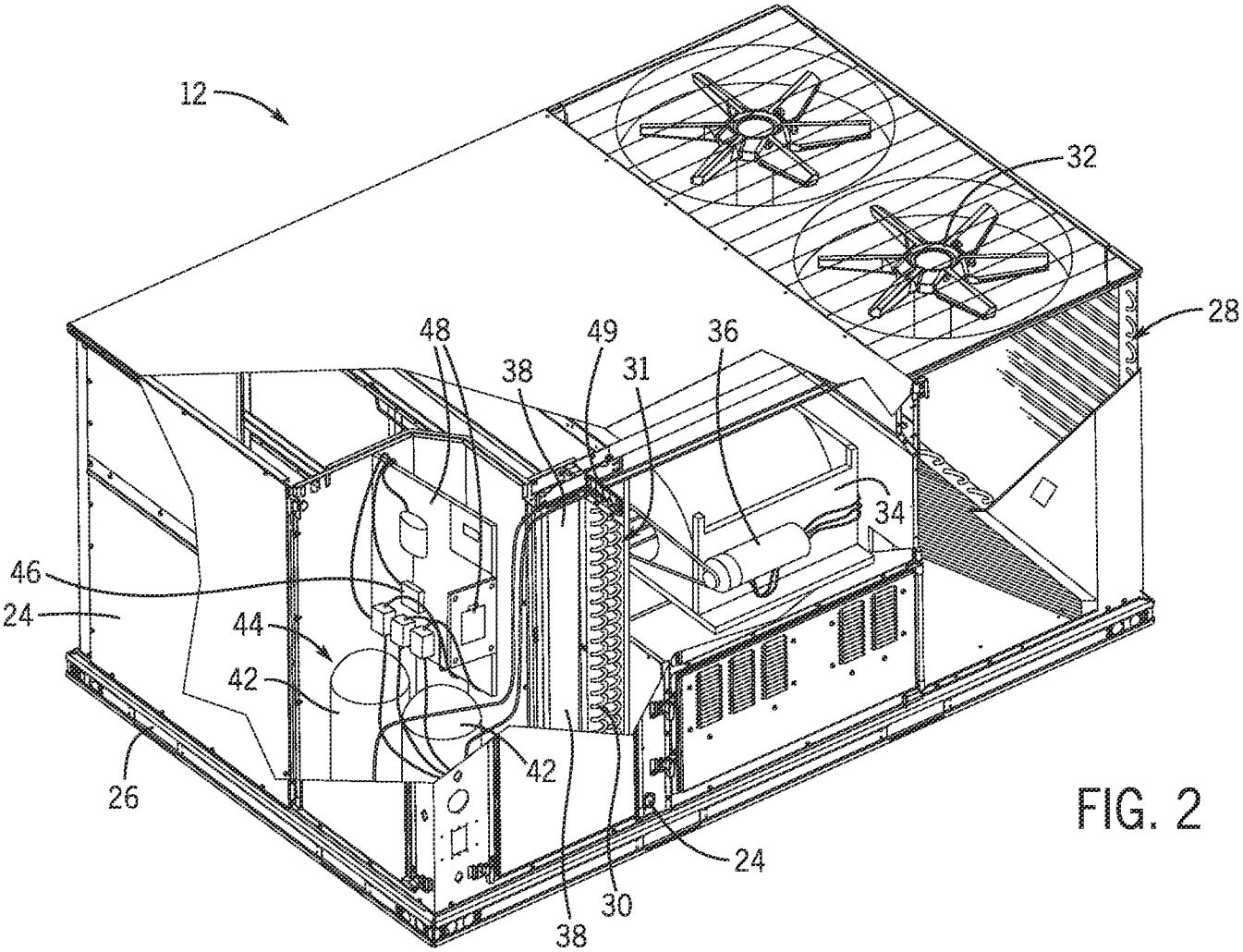
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent vapor compression circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air flow provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more vapor compression circuits (e.g., working fluid circuits). Tubes within the heat exchangers 28 and 30 may circulate a working fluid (e.g., refrigerant), such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the working fluid undergoes phase changes and/or temperature changes as it flows through the heat exchangers 28 and 30 to produce heated and/or cooled air. For example, the heat exchanger 28 may function as a condenser where heat is released from the working fluid to ambient air, and the heat exchanger 30 may function as an evaporator where the working fluid absorbs heat to cool an air flow. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air flow that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the working fluid before the working fluid enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
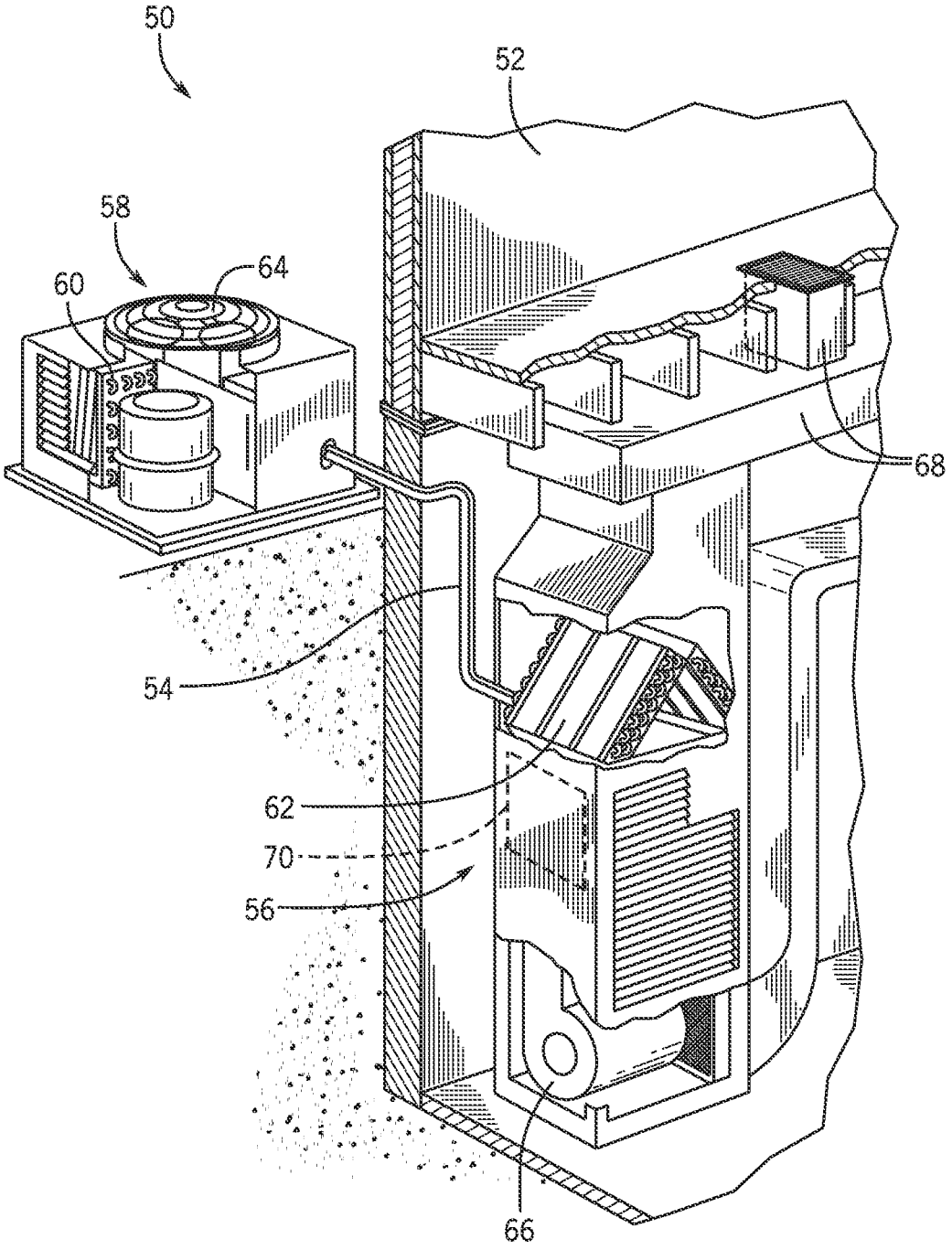
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include working fluid conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The working fluid conduits 54 transfer working fluid between the indoor unit 56 and the outdoor unit 58, typically transferring primarily liquid working fluid in one direction and primarily vaporized working fluid in an opposite direction.

When the system shown in FIG. 3 is operating as an air conditioner, a heat exchanger 60 in the outdoor unit 58 serves as a condenser for re-condensing vaporized working fluid flowing from the indoor unit 56 to the outdoor unit 58 via one of the working fluid conduits 54. In these applications, a heat exchanger 62 of the indoor unit functions as an evaporator. Specifically, the heat exchanger 62 receives liquid working fluid, which may be expanded by an expansion device, and evaporates the working fluid before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to cool additional air for circulation through the residence 52. When the temperature reaches the set point, or the set point minus a small amount, the residential heating and cooling system 50 may stop the vapor compression cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate working fluid and thereby cool air entering the outdoor unit 58 as the air passes over the outdoor heat exchanger 60. The indoor heat exchanger 62 will receive a flow of air blown over it and will heat the air by condensing the working fluid.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
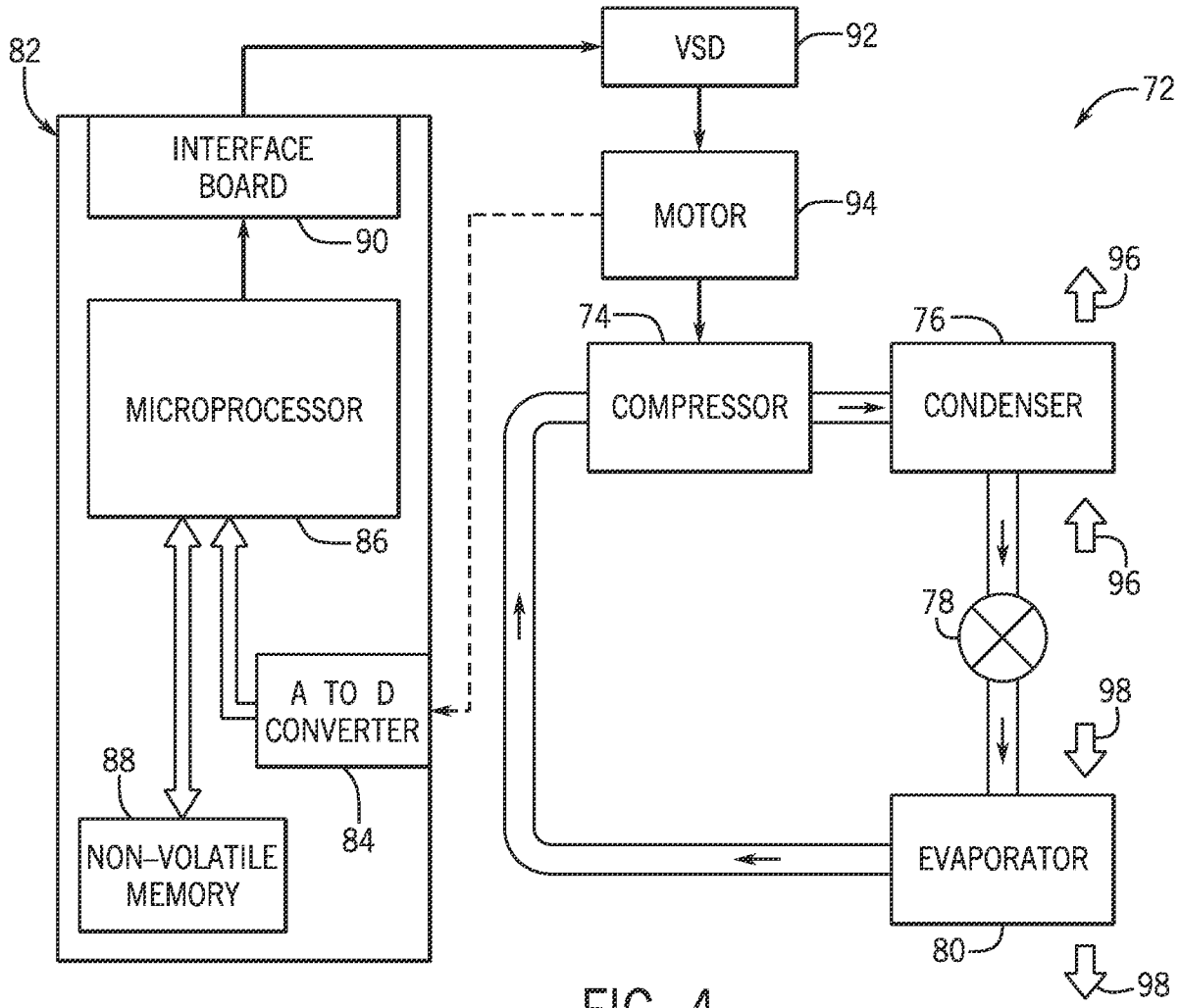
FIG. 4 is a schematic diagram of an embodiment of a vapor compression system used in an HVAC system, in accordance with an aspect of the present disclosure.

FIG. 4 is an embodiment of a vapor compression system 72 that can be used in any of the systems described above. The vapor compression system 72 may circulate a working fluid (e.g., refrigerant) through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a working fluid vapor and delivers the vapor to the condenser 76 through a discharge passage. In some embodiments, the compressor 74 may be a centrifugal compressor. The working fluid vapor delivered by the compressor 74 to the condenser 76 may transfer heat to a fluid passing across the condenser 76, such as ambient or environmental air 96. The working fluid vapor may condense to a working fluid liquid in the condenser 76 as a result of thermal heat transfer with the environmental air 96. The liquid working fluid from the condenser 76 may flow through the expansion device 78 to the evaporator 80.

The liquid working fluid delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid working fluid in the evaporator 80 may undergo a phase change from the liquid working fluid to a working fluid vapor. In this manner, the evaporator 80 may reduce the temperature of the supply air stream 98 via thermal heat transfer with the working fluid. Thereafter, the vapor working fluid exits the evaporator 80 and returns to the compressor 74 by a suction line to complete the cycle.

In some embodiments, the vapor compression system 72 may further include a reheat coil. In the illustrated embodiment, the reheat coil is represented as part of the evaporator 80. The reheat coil is positioned downstream of the evaporator heat exchanger relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air flow provided to a building or other load, embodiments of the present disclosure may be applicable to other HVAC systems as well. For example, the features described herein may be applied to mechanical cooling systems, free cooling systems, chiller systems, heat pumps, or other HVAC applications.

As briefly discussed above, embodiments of the present disclosure are directed to an HVAC system configured to enable improved (e.g., continued) operation during operating conditions that may otherwise cause operational interruptions of the HVAC system. For example, the disclosed techniques may be incorporated with HVAC systems configured as an air conditioning system, a heat pump system, a furnace system, another suitable HVAC system, or any combination thereof. Disclosed embodiments include a control system configured to detect one or more operating parameters of the HVAC system and to execute one or more remedial operations to block or mitigate a detected value of an operating parameter from reaching an operating parameter limit that may otherwise cause an operational interruption of the HVAC system.

Figure 5:
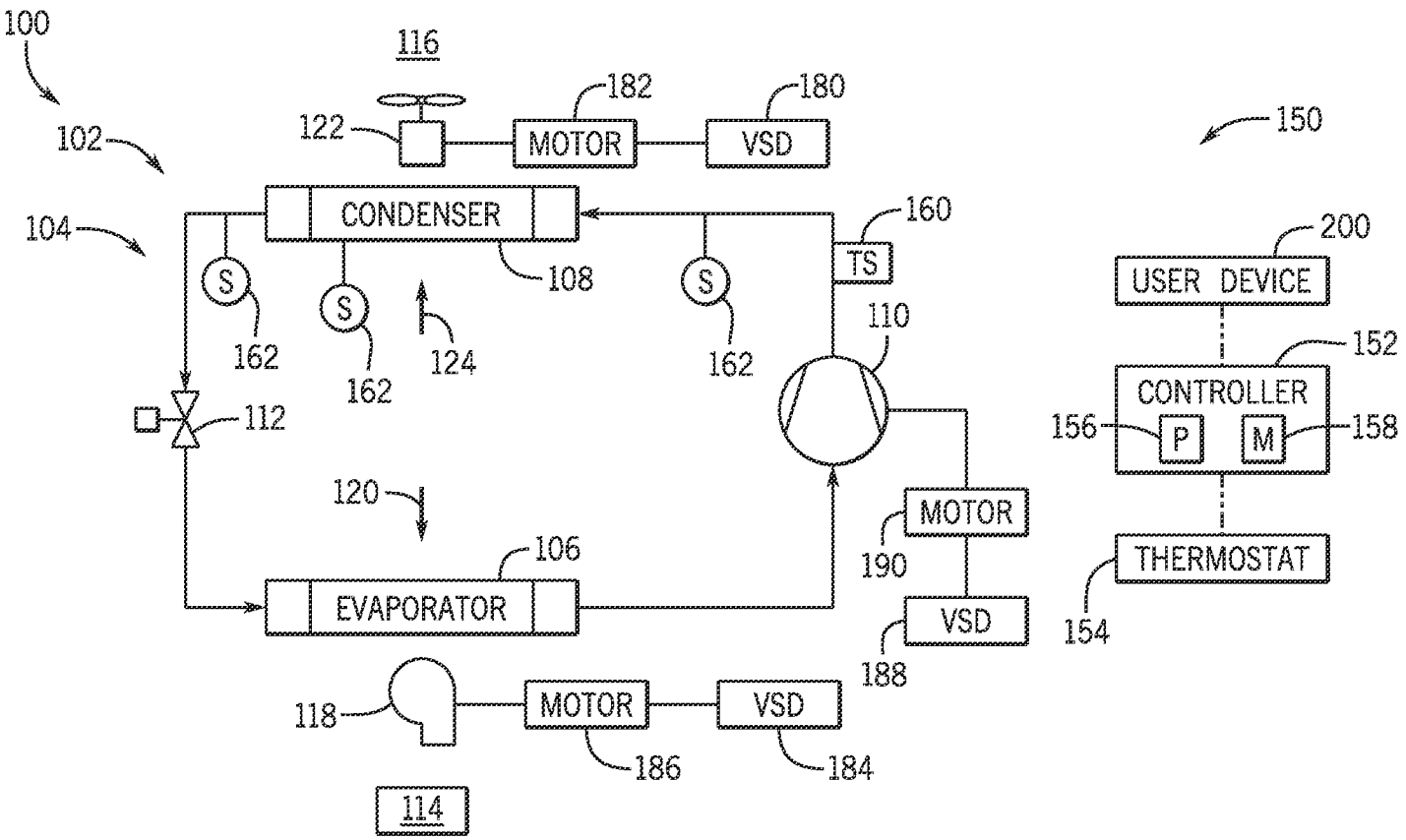
FIG. 5 is a schematic diagram of an embodiment of an HVAC system including a vapor compression circuit and a control system, in accordance with an aspect of the present disclosure.

To provide context for the following discussion, FIG. 5 is a schematic of an embodiment of an HVAC system 100 that includes a vapor compression system 102, in accordance with present techniques. It should be appreciated that the HVAC system 100 may include embodiments or components of the HVAC unit 12 shown in FIGS. 1 and 2, embodiments or components of the split residential heating and cooling system 50 shown in FIG. 3, embodiments or components of the vapor compression 72 shown in FIG. 4, a rooftop unit (RTU), or any other suitable air handling unit or HVAC system.

In the illustrated embodiment, the vapor compression system 102 includes a working fluid circuit 104 (e.g., refrigerant circuit) having an evaporator 106 (e.g., indoor heat exchanger, first heat exchanger), a condenser 108 (e.g., outdoor heat exchanger, second heat exchanger), a compressor 110, and an expansion valve 112 (e.g., an electronic expansion valve, expansion device). The evaporator 106 may be in thermal communication with (e.g., fluidly coupled to) a thermal load 114 (e.g., a room, space, and/or device) serviced by the HVAC system 100, and the condenser 108 may be in thermal communication with an ambient environment 116 (e.g., the atmosphere) surrounding the HVAC system 100. The HVAC system 100 also includes a first fan 118 (e.g., blower, indoor fan, supply air fan) configured to direct a first air flow 120 across the evaporator 106 to facilitate heat exchange between working fluid within the evaporator 106 and the first air flow 120 directed to the thermal load 114. A second fan 122 (e.g., outdoor fan, condenser fan) may direct a second air flow 124 across the condenser 108 to facilitate heat exchange between working fluid within the condenser 108 and the second air flow 124 of the ambient environment 116. The expansion valve 112 is disposed along the working fluid circuit 104 between the evaporator 106 and the condenser 108 and may be configured to regulate (e.g., throttle) a working fluid flow and/or a working fluid pressure differential between the evaporator 106 and the condenser 108.

The illustrated embodiment of the HVAC system 100 is configured to operate as an air conditioner. That is, the HVAC system 100 is configured to operate in a cooling mode to provide cooling to the thermal load 114. To this end, the compressor 110 is configured to direct a flow of heated working fluid along the working fluid circuit 104 to the condenser 108. The condenser 108 is configured to transfer thermal energy (e.g., heat) from the working fluid to the second air flow 124, thereby cooling and condensing the working fluid. The working fluid may then flow from the condenser 108, along the working fluid circuit 104, and through the expansion valve 112, which may reduce a pressure of the working fluid and further cool the working fluid. The cooled working fluid is then directed to the evaporator 106, which is configured to enable transfer of thermal energy from the first air flow 120 to the working fluid. In this way, the first air flow 120 may be cooled, and the first air flow 120 may be directed (e.g., via the first fan 118) to a conditioned space to provide cooling for the conditioned space. The working fluid may then be directed from the evaporator 106 back to the compressor 110, as similarly discussed above.

Figure 6:
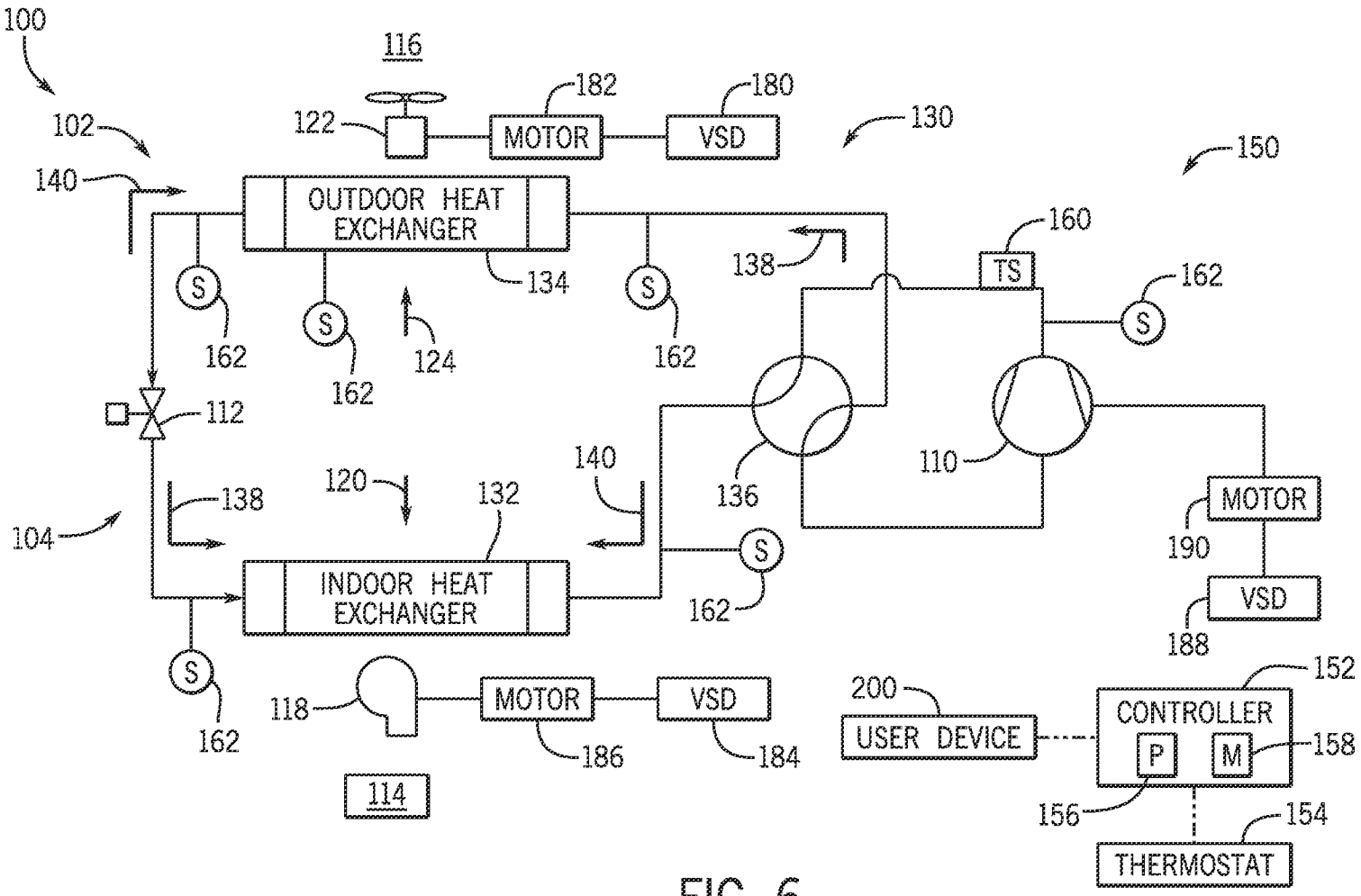
FIG. 6 is a schematic diagram of an embodiment of an HVAC system including a vapor compression circuit and a control system, in accordance with an aspect of the present disclosure.

The present techniques may also be incorporated with embodiments of the HVAC system 100 configured as a heat pump. For example, FIG. 6 is a schematic of an embodiment of the HVAC system 100 including the vapor compression system 102 configured as a heat pump system 130. The illustrated embodiment includes elements and element numbers similar to those discussed above with reference to FIG. 5. For example, the vapor compression system 102 includes the working fluid circuit 104 having an indoor heat exchanger 132 (e.g., evaporator, first heat exchanger), an outdoor heat exchanger 134 (e.g., condenser, second heat exchanger), the compressor 110, and the expansion valve 112. The working fluid circuit 104 also includes a reversing valve 136 (e.g., switch-over valve) configured to adjust (e.g., reverse) a flow direction of the working fluid along the working fluid circuit 104 of the heat pump system 130.

During operation of the heat pump system 130 in a cooling mode, the compressor 110 may direct working fluid through the working fluid circuit 104, the indoor heat exchanger 132, and the outdoor heat exchanger 134 in a first flow direction 138. While receiving working fluid in the first flow direction 138, the indoor heat exchanger 132, which is in thermal communication with the thermal load 114, may operate as an evaporator. Thus, working fluid flowing through the indoor heat exchanger 132 may absorb thermal energy from the first air flow 120 directed to the thermal load 114. The outdoor heat exchanger 134, which may be positioned in the ambient environment 116 surrounding the heat pump system 130, may operate as a condenser to reject the heat absorbed by the working fluid flowing from the indoor heat exchanger 132 to the second air flow 124 (e.g., ambient air flow) directed across the outdoor heat exchanger 134. During operation of the heat pump system 130 in a heating mode, the reversing valve 136 enables the compressor 110 to direct working fluid through the working fluid circuit 104, the indoor heat exchanger 132, and the outdoor heat exchanger 134 in a second flow direction 140, opposite the first flow direction 138. While receiving working fluid in the second flow direction 140, the indoor heat exchanger 132 may operate as a condenser instead of an evaporator, and the outdoor heat exchanger 134 may operate as an evaporator instead of a condenser. As such, the indoor heat exchanger 132 may receive (e.g., from the compressor 110) a flow of heated working fluid to reject heat to the first air flow 120 directed to the thermal load 114 and thereby facilitate heating of the thermal load 114.

The following discussion continues with concurrent reference to FIGS. 5 and 6. In accordance with present techniques, the HVAC system 100 (e.g., vapor compression system 102, air conditioning system, heat pump system 130) includes a control system 150 configured to enable improved operation of the HVAC system 100. The control system 150 includes a controller 152 (e.g., control panel, control circuitry) that is communicatively coupled to one or more components of the HVAC system 100 (e.g., compressor 110, expansion valve 112, first fan 118, second fan 122) and is configured to monitor, adjust, and/or otherwise control operation of the components of the HVAC system 100. For example, one or more control transfer devices, such as wires, cables, wireless communication devices, and the like, may communicatively couple the compressor 110, the expansion valve 112, the first fan 118, the second fan 122, the control device 16 (e.g., a thermostat 154), and/or any other suitable components of the HVAC system 100 to the controller 152. That is, the compressor 110, the expansion valve 112, the first fan 118, the second fan 122, and/or the control device 16 (e.g., thermostat 154) may each have one or more communication components that facilitate wired or wireless (e.g., via a network) communication with the controller 152. In some embodiments, the communication components may include a network interface that enables the components of the HVAC system 100 to communicate via various protocols such as EtherNet/IP, ControlNet, DeviceNet, or any other communication network protocol. Alternatively, the communication components may enable the components of the HVAC system 100 to communicate via mobile telecommunications technology, Bluetooth®, near-field communications technology, and the like. As such, the compressor 110, the expansion valve 112, the first fan 118, the second fan 122, and/or the control device 16 may wirelessly communicate data between each other. In other embodiments, operational control of certain components of the HVAC system 100 may be regulated by one or more relays or switches (e.g., a 24 volt alternating current [VAC] relay).

In some embodiments, the controller 152 may be a component of or may include the control panel 82. In other embodiments, the controller 150 may be a standalone controller, a dedicated controller, or another suitable controller included in the HVAC system 100. In any case, the controller 152 is configured to control components of the HVAC system 100 in accordance with the techniques discussed herein. The controller 152 includes processing circuitry 156, such as a microprocessor, which may execute software for controlling the components of the HVAC system 100. The processing circuitry 156 may include multiple microprocessors, one or more "general-purpose" microprocessors, one or more special-purpose microprocessors, and/or one or more application specific integrated circuits (ASICS), or some combination thereof. For example, the processing circuitry 156 may include one or more reduced instruction set (RISC) processors.

The controller 152 also include a memory device 158 (e.g., a memory) that may store information, such as instructions, control software, look up tables, configuration data, etc. The memory device 158 may include a volatile memory, such as random access memory (RAM), and/or a nonvolatile memory, such as read-only memory (ROM). The memory device 158 may store a variety of information and may be used for various purposes. For example, the memory device 158 may store processor-executable instructions including firmware or software for the processing circuitry 156 execute, such as instructions for controlling components of the HVAC system 100. In some embodiments, the memory device 158 is a tangible, non-transitory, machine-readable-medium that may store machine-readable instructions for the processing circuitry 156 to execute. The memory device 158 may include ROM, flash memory, a hard drive, or any other suitable optical, magnetic, or solid-state storage medium, or a combination thereof. The memory device 158 may store data, instructions, and any other suitable data.

As mentioned above, the HVAC system 100 may be configured to suspend operation in response to detection of an operating parameter value that reaches (e.g., exceeds) an operating parameter limit. For example, the HVAC system 100 may include a trip switch 160 (e.g., switch, electric switch, interrupt switch, limit switch, pressure switch, temperature switch, one or more trip switches) configured to interrupt supply of power to the compressor 110 of the vapor compression system 102 in response to detection of an operating parameter value (e.g., a first value) that reaches an operating parameter limit. To this end, the trip switch 160 may be coupled (e.g., communicatively coupled, electrically coupled) to the compressor 110, the controller 152, a power source configured to supply power to the compressor 110 and/or the HVAC system 100, or any combination thereof.

In some embodiments, the trip switch 160 may be disposed along the working fluid circuit 104. The trip switch 160 may be configured to detect any suitable operating parameter of the HVAC system 100, such as a working fluid pressure (e.g., discharge pressure, suction pressure), a working fluid temperature (e.g., discharge temperature, suction temperature), another suitable operating parameter, or any combination thereof. In response to detection of an operating parameter value that reaches or exceeds (e.g., rises above, falls below) an operating parameter limit (e.g., trip set point), the trip switch 160 may be actuated and may cause supply of power to the compressor 110 and/or the HVAC system 100 to be interrupted, thereby suspending operation of the vapor compression system 102. Additionally or alternatively, the controller 152 may be configured to detect actuation of the trip switch 160 and, in response, may instruct the compressor 110 to transition to a non-operating state. In some instances, actuation of the trip switch 160 may cause a lockout of the HVAC system 100, such that intervention by a technician or other operator is demanded to enable resumed operation of the HVAC system 100. Unfortunately, in such instances, the HVAC system 100 may not operate to condition the first air flow 120 for supply to the thermal load 114.

Accordingly, the present techniques include the control system 150 configured to detect one or more operating parameters of the HVAC system 100 and to implement remedial or compensatory operations to mitigate actuation of the trip switch 160 (e.g., based on a detected value of an operating parameter). As will be appreciated, during normal operation of the HVAC system 100, the control system 150 may be configured to operate components of the HVAC system 100 based on a cooling and/or heating demand of the HVAC system 100 (e.g., indicated by commands and/or signals received from the thermostat 154). However, in accordance with present techniques, the controller 152 may be configured to override (e.g., temporarily override) control based on signals and/or commands (e.g., set point temperature of the conditioned space, calls for heating and/or cooling) received from the thermostat 154 in order to implement one or more remedial or compensatory operations to mitigate actuation of the trip switch 160 and avoid operational interruptions of the HVAC system 100.

To enable the functionality described herein, the control system 150 includes one or more sensors 162 configured to detect one or more operating parameters (e.g., one or more operating parameter values, one or more second values of the operating parameter) of the HVAC system 100. In the illustrated embodiments of FIGS. 5 and 6, the one or more sensors 162 are configured to detect any suitable operating parameter of the vapor compression system 102. For example, one of the sensors 162 may be configured to detect a discharge pressure of the working fluid (e.g., pressure of the working fluid discharged by the compressor 110), a discharge temperature of the working fluid, a suction pressure of the working fluid entering the compressor 110, a suction temperature of the working fluid, a temperature and/or pressure of the condenser 108 and/or outdoor heat exchanger 134, a temperature and/or pressure of the evaporator 106 and/or indoor heat exchanger 132, a subcooled temperature of the working fluid, a superheated temperature of the working fluid, another suitable operating parameter, or any combination thereof. In some embodiments, one of the sensors 162 may be configured to detect the same operating parameter as that detected by the trip switch 160.

As mentioned above, the controller 152 is configured to receive data and/or feedback from the one or more sensors 162 indicative operating parameter values detected by the one or more sensors 162. Based on the operating parameter values, the controller 152 may implement or execute a control action, such as a remedial action, to mitigate an operating parameter value reaching or exceeding an operating parameter limit value (e.g., limit value, upper limit value, trip value) that may otherwise cause actuation or tripping of the trip switch 160. For example, based on one or more operating parameter values detected by one of the sensors 162 and received by the controller 152, the controller 152 may determine that the operating parameter value is approaching the operating parameter limit that may cause the trip switch 160 to actuate.

As an example, the operating parameter may be a discharge pressure of the working fluid exiting the compressor 110, and the trip switch 160 may be configured to actuate and suspend operation of the compressor 110 in response to detection of a trip value or operating parameter limit value of the discharge pressure. To mitigate actuation of the trip switch 160, the controller 152 may be configured to determine whether a discharge pressure value detected by one of the sensors 162 reaches or exceeds a threshold value (e.g., first threshold value) of the discharge pressure, where the threshold value is less than the trip value or operating parameter limit value of the discharge pressure that causes the trip switch 160 to actuate. The threshold value may be any suitable value that is less than the trip value of the trip switch 160 by any suitable amount or magnitude (e.g., by a safety margin). In some embodiments, the threshold value may be stored in the memory device 158 and may be referenced by the controller 152 during execution of the techniques described herein.

In response to a determination that a detected value of the discharge pressure exceeds the threshold value, the controller 152 may control one or more components of the HVAC system 100 to induce or cause a reduction in the discharge pressure of the working fluid, as described further below. That is, the controller 152 may compare the detected value of the discharge pressure received from the sensor 162 with the threshold value and determine whether the detected value exceeds the threshold value.

In some embodiments, the controller 152 may be configured to compare the detected value of the discharge pressure (e.g., operating parameter) with multiple threshold values (e.g., discharge pressure values, threshold values stored in the memory device 158), where each threshold value is less than the trip value or operating parameter limit value that causes the trip switch 160 to actuate and interrupt operation of the vapor compression system 102. For example, the controller 152 may be configured to compare the detected discharge pressure value to a first discharge pressure threshold value that is less than the discharge pressure trip value and to compare the detected discharge pressure value to a second discharge pressure threshold value that is less than the discharge pressure trip value and greater than the first discharge pressure threshold value. In some embodiments, in response to a determination that the detected discharge pressure value is greater than the first discharge pressure threshold value and less than the second discharge pressure threshold value, the controller 152 may implement a first remedial action or operation. In response to a determination that the detected discharge pressure value is greater than the first discharge pressure threshold value and is also greater than the second discharge pressure threshold value, the controller 152 may implement a second remedial action or operation (e.g., instead of or in addition to the first remedial operation). In some instances, the second remedial operation may be configured to reduce the discharge pressure by a greater amount than the first remedial operation, as described in further detail below. Indeed, the controller 152 may be configured to compare the detected value of the discharge pressure to any suitable number of discharge pressure threshold values that are each less than the discharge pressure trip value to enable a determination that the discharge pressure is approaching the discharge pressure trip value associated with actuation of the trip switch 160. Similarly, the controller 152 may be configured to determine and/or execute any suitable number or types of remedial or compensatory operations to enable a reduction in the discharge pressure to mitigate instances of the discharge pressure reaching the discharge pressure trip value.

Still further, in some embodiments, the controller 152 may determine a suitable remedial operation based on a rate of change of the detected discharge pressure or other operating parameter. For example, the controller 152 may be configured to receive data and/or feedback (e.g., updated data) from the one or more sensors 162 at a predetermined rate or interval, and the controller 152 may determine a rate at which the detected discharge pressure changes, such as increases towards the discharge pressure trip value. Based on a determined rate of change, the controller 152 may determine one or more desired remedial operations and/or a desired manner in which to execute the one or more remedial operations. Details of remedial operations that may be executed by the controller 152 in accordance with the present techniques are described further below.

As mentioned above, it should be appreciated that the sensors 162 may be configured to detect any suitable operating parameter that may correspond to and/or be associated with actuation of the trip switch 160. The controller 152 may therefore be configured to compare detected values of any suitable operating parameter with one or more corresponding threshold values (e.g., stored in the memory device 158), as similarly described above. For example, in an embodiment, one of the sensors 162 may be configured to detect a suction pressure value, and the controller 152 may be configured to compare the detected suction pressure value with a corresponding suction pressure threshold value that is greater than a corresponding suction pressure trip value. Based on a determination that the detected suction pressure value is less than the corresponding suction pressure threshold value, the controller 152 may determine and execute a corresponding remedial action or operation to enable an increase in the suction pressure of the working fluid to avoid tripping of the trip switch 160 that may otherwise be caused by the suction pressure falling below the suction pressure trip value. For example, the controller 152 may determine and enable a reduction in a speed of the compressor 110, an increase in a speed of the first fan 118 and/or the second fan 122, and so forth. As discussed above, other operating parameter values that may be detected (e.g., by the sensors 162) and evaluated (e.g., by the controller 152) to determine whether and how to implement one or more remedial operations include suction and/or discharge temperatures of the working fluid, a subcooled temperature of the working fluid, a superheated temperature of the working fluid, and so forth. Additionally or alternatively, in some embodiments the controller 152 may reference historical operating data of the vapor compression system 102 (e.g., historical discharge pressures, stored in the memory device 158) to determine whether and how to implement a remedial operation to mitigate instances of an operating parameter value reaching a trip value that may cause operational interruption of the vapor compression system 102.

In response to a determination that the detected operating parameter value exceeds (e.g., rises above, falls below) one or more corresponding threshold values, the controller 152 may determine a desired remedial control operation. The controller 152 may be configured to select a remedial control operation from a plurality of remedial control operations. Continuing with the example of discharge pressure as the operating parameter value, in response to a determination that the detected discharge pressure value exceeds a discharge pressure threshold value that is less than the discharge pressure trip value, the controller 152 may execute one or more remedial operations including adjusting a speed of the second fan 122, adjusting a speed of the first fan 118, adjusting a speed of the compressor 110, or any combination thereof. In some implementations, different remedial operations may be executed in a sequential or progressive manner.

For example, in an embodiment of the vapor compression system 102 configured as an air conditioning system, the controller 152 may initially implement (e.g., determine, select) a remedial operation (e.g., first remedial operation) including increasing a speed of the second fan 122 (e.g., outdoor fan, condenser fan) in response to a determination that a detected discharge pressure value exceeds a discharge pressure threshold value, such as a lower threshold value (e.g., first threshold value). To this end, the controller 152 may be communicatively coupled to a variable speed drive (VSD) 180 (e.g., second VSD, outdoor fan VSD) configured to drive operation of a motor 182 (e.g., second motor) associated with the second fan 122. In this way, the flow rate of the second air flow 124 directed across the condenser 108 may be increased, thereby increasing heat transfer from the working fluid to the second air flow 124 via the condenser 108 and causing a reduction in the discharge pressure. The vapor compression system 102 configured as the heat pump system 130 may operate in a similar manner in a cooling mode of the heat pump system 130 (e.g., to increase the flow rate of the second air flow 124 across the outdoor heat exchanger 134). On the other hand, in a heating mode of the heat pump system 130, and in response to a determination that a detected discharge pressure value exceeds a discharge pressure threshold value (e.g., a lower threshold value, first threshold value), the controller 152 may instead operate to increase a speed of the first fan 118, such as via control of a VSD 184 (e.g., first VSD, indoor fan VSD) configured to drive operation of a motor 186 (e.g., first motor) associated with the first fan 118. In this way, heat transfer from the working fluid to the first air flow 120 may be increased and the discharge pressure of the working fluid may be reduced in the heating mode of the heat pump system 130.

In some embodiments, the controller 152 may increase a speed of the first fan 118 in addition to (e.g., simultaneously), or instead of, increasing the speed of the second fan 122 in the cooling mode of the vapor compression system 102 and/or may increase a speed of the second fan 122 in addition to or instead of increasing the speed of the first fan 118 in the heating mode of the heat pump system 130. As another example, in the cooling mode of the vapor compression system 102, the controller 152 may initially increase a speed of the second fan 122 as a first remedial operation and may subsequently additionally increase a speed of the first fan 118 as an additional remedial operation, such as in response to a determination that the detected discharge pressure value does not fall below a corresponding discharge pressure threshold value after a predetermined amount of time. Similarly, in the heating mode of the heat pump system 130, the controller 152 may initially increase a speed of the first fan 118 as a first remedial operation and may subsequently additionally increase a speed of the second fan 122 as a second remedial operation, such as in response to a determination that the detected discharge pressure value does not fall below a corresponding discharge pressure threshold value after a predetermined amount of time.

In some embodiments, the controller 152 may be configured to incrementally increase the speed of the second fan 122 and/or the first fan 118 based on an amount of time elapsed since initial execution of the corresponding remedial operation (e.g., initial increase in speed of the second fan 122 and/or the first fan 118). As will be appreciated, implementation of such remedial operations as an initial remedial operation may avoid reducing an operating speed of the compressor 110 that would otherwise limit or reduce an operating capacity of the vapor compression system 102 (e.g., configured as an air conditioner or as the heat pump system 130).

Additionally or alternatively, the controller 152 may implement another remedial operation in response to a determination that a detected operating parameter value exceeds one or more corresponding threshold values. Continuing with the discharge pressure example above, in response to a determination that the detected discharge pressure value exceeds another discharge pressure threshold value, such as an upper threshold value (e.g., second threshold value) that is greater than the lower threshold value, the controller 152 may execute an additional or alternative remedial operation (e.g., second remedial operation) including decreasing a speed of the compressor 110. Similarly, the controller 152 may execute an additional or alternative remedial operation, such as decreasing the speed of the compressor 110, in response to a determination that the detected discharge pressure value does not decrease below the first or lower threshold value after lapse of a predetermined amount of time since implementation or execution of an initial or first remedial operation (e.g., increasing the speed of the second fan 122). To this end, the controller 152 may instruct a VSD 188 (e.g., third VSD, compressor VSD) configured to drive operation of a motor 190 of the compressor 110. By reducing the speed of the compressor 110, the controller 152 may enable a reduction in the discharge pressure of the working fluid, such that the discharge pressure does not reach or exceed the discharge pressure trip value that would otherwise cause actuation of the trip switch 160.

In some embodiments, the controller 152 may determine which of one or more remedial operations to execute and/or a manner (e.g., a sequential order) in which to execute the one or more remedial operations based on a magnitude of the operating parameter value relative to other operating parameter values (e.g., relative to one or more operating parameter threshold values, relative to an operating parameter trip value). For example, the controller 152 may determine a magnitude of a speed increase of the first fan 118, the second fan 122, or both, based on an amount by which the detected operating parameter value exceeds a particular threshold value and/or based on an amount by which the detected operating parameter value is below the operating parameter trip value. Similarly, the controller 152 may determine a magnitude of a speed decrease of the compressor 110 based on an amount by which the detected operating parameter value exceeds a particular threshold value and/or based on an amount by which the detected operating parameter value is below the operating parameter trip value. Additionally or alternatively, a time period during which the remedial operation is implemented may be based on such determined magnitudes. In some embodiments, particular operating adjustments (e.g., adjustment values, fan speed adjustment values, compressor speed adjustment values, time durations for operating adjustments) may be associated with corresponding operating parameter values (e.g., detected operating parameter values). The correlations between such corresponding adjustments and values may be stored in the memory device 158 and may be referenced by the controller 152 during execution of the techniques described herein.

During execution of one or more of the remedial operations, the controller 152 may continue to receive data and/or feedback from the sensors 162 and may iteratively or continually adjust implementation of the remedial operations (e.g., adjust respective speeds of the first fan 118, the second fan 122, and/or the compressor 110) to maintain the operating parameter (e.g., discharge pressure, suction pressure) below or above the corresponding operating parameter trip value. In this manner, actuation of the trip switch 160 may be avoided, continued operation of the HVAC system 100 may be achieved, and operational integrity (e.g., protection) of the components of the HVAC system 100 may be maintained.

In some embodiments, the controller 152 may be configured to execute other remedial operations in addition to or instead of those described above. Indeed, any suitable operating parameter of the vapor compression system 102 may be adjusted to mitigate instances of an operating parameter reaching a corresponding operational limit value or trip value that may otherwise cause the trip switch 160 to actuate and interrupt operation of the vapor compression system 102. For example, to control or adjust a suction pressure of the working fluid entering the compressor 110 (e.g., maintain the suction pressure above a corresponding suction pressure trip value), the controller 152 may be configured to adjust operation of the first fan 118, the second fan 122, and/or the compressor 110, as discussed above. Additionally or alternatively, the controller 152 may be configured to adjust the expansion valve 112 to increase the suction pressure of the working fluid (e.g., above a corresponding threshold value that is greater than the suction pressure trip value).

In additional to the functionality described above, the controller 152 may also be configured to output an alert in response to a determination that an operating parameter of the vapor compression system 102 is approaching a corresponding operating parameter limit or trip value. For example, in response to a determination that a detected operating parameter value exceeds one or more corresponding threshold values and/or is within a threshold amount of the corresponding trip value, the controller 152 may output a notification to a user device 200. The controller 152 may additionally or alternatively output the alert or notification to the thermostat 154 (e.g., a display of the thermostat 154). The user device 200 may be any suitable device that may be communicatively coupled to the HVAC system 100 (e.g., the controller 152), such as via a wireless network, the Internet, or other suitable communication channel. In some embodiments, the user device 200 may be a personal computer, a mobile device, a tablet, and so forth. The user device 200 may also be configured to receive a user input and communicate the user input to the controller 152. For example, the user device 200 may be configured to receive inputs indicative of one or more of the operating parameter threshold values described herein. In some embodiments, the controller 152 may store user inputs (e.g., values, data) received from the user device 200 in the memory device 158.

The notification may indicate or include any suitable data or information associated with the detections and determinations described herein. For example, the notification may include an indication (e.g., measurement) of the detected operating parameter value, a comparison of the detected operating parameter value with a corresponding trip value, an indication of one or more operating parameter threshold values exceeded by the detected operating parameter value, an indication of one or more remedial operations executed by the controller 152, a duration of time for which the detected operating parameter value has exceeded one or more operating parameter threshold values, a duration of time for which one or more remedial operations have been executed, a number of instances that one or more remedial operations have been executed, or any combination thereof. In this way, an operator, technician, homeowner, or other party associated with the HVAC system 100 may be notified regarding the operational status and characteristics of the HVAC system 100. In some instances, the notification or alert may prompt an associated party to schedule maintenance or service for the HVAC system 100 to mitigate potential future operational complications and/or interruptions.

Figure 7:
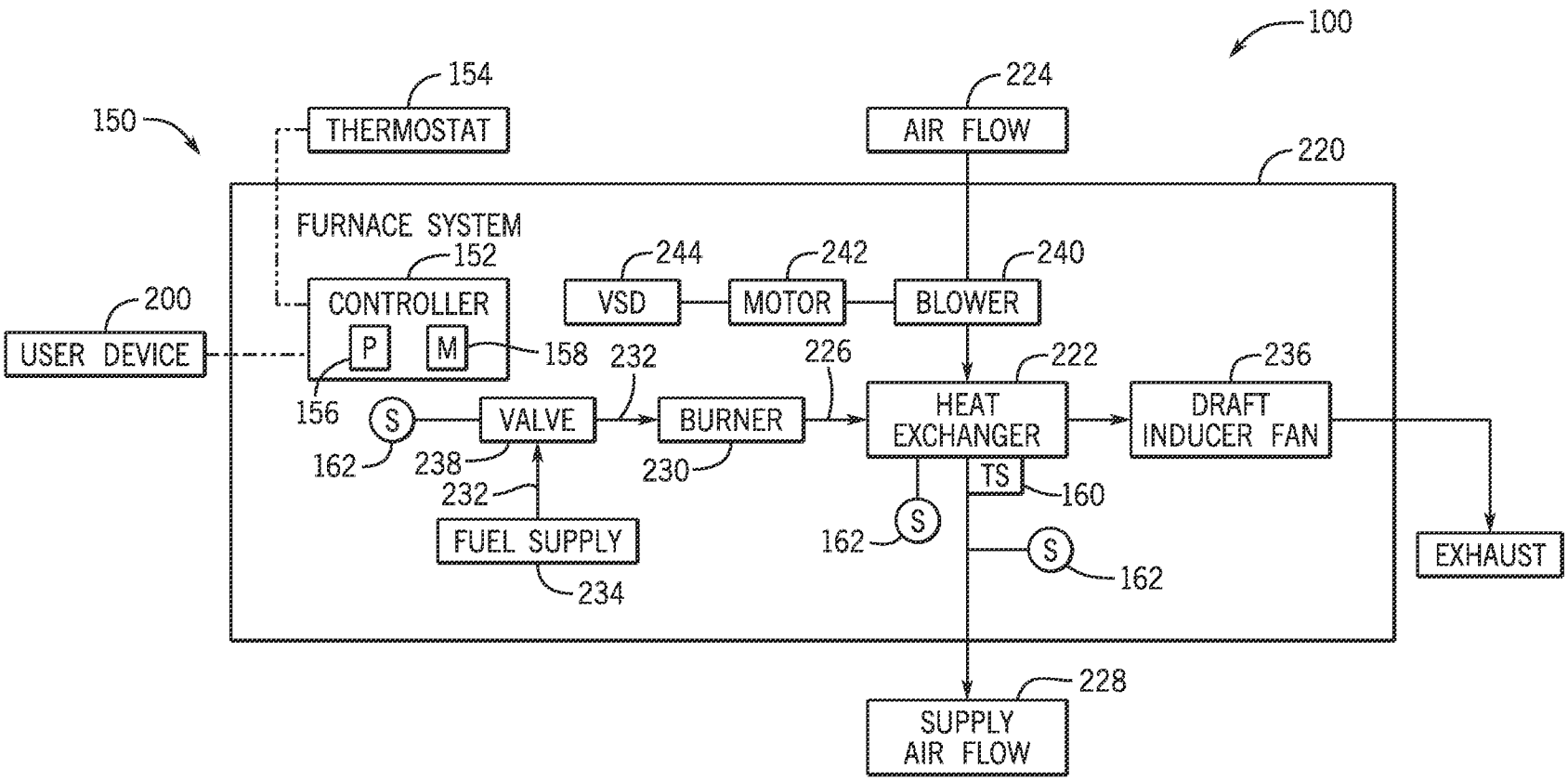
FIG. 7 is a schematic diagram of an embodiment of an HVAC system including a furnace system and a control system, in accordance with an aspect of the present disclosure.

FIG. 7 is a schematic of an embodiment of a portion of the HVAC system 100, illustrating a furnace system 220 (e.g., a furnace). The furnace system 220 may be an embodiment of the furnace system 70 incorporated with the residential heating and cooling system 50 discussed above. However, it should be appreciated that the furnace system 220 may be incorporated with embodiments of the HVAC unit 12, the vapor compression system 72, and/or any other suitable HVAC system. The HVAC system 100 also includes an embodiment of the control system 150 and includes similar elements and element numbers as those discussed above with reference to FIGS. 5 and 6, such as the controller 152, the thermostat 154, the trip switch 160 (e.g., switch, electric switch, interrupt switch, limit switch, pressure switch, one or more trip switches), the sensors 162, the user device 200, and so forth. As discussed further below, the control system 150 is configured to implement the techniques described herein to mitigation actuation of the trip switch 160 and subsequent operational interruption of the furnace system 220.

The furnace system 220 includes a heat exchanger 222 configured to heat an air flow 224 (e.g., a return air flow, an ambient air flow, a mixed air flow, a supply air flow) directed across the heat exchanger 222. The heat exchanger 222 may include one or more tubes configured to receive combustion products 226 (e.g., a working fluid), and the heat exchanger 222 may place the air flow 224 in a heat exchange relationship with the combustion products 226 to transfer heat from the combustion products 226 to the air flow 224, thereby heating the air flow 224 to produce a supply air flow 228 (e.g., heated air flow). The furnace system 220 also includes a burner 230 configured to receive fuel 232 from a fuel supply 234. The burner 230 may ignite the fuel 232 (e.g., an air-fuel mixture) to produce the combustion products 226, and a draft inducer fan 236 (e.g., a draft inducer blower, draft inducer) may direct (e.g., force, draw) the combustion products 226 through the heat exchanger 222 (e.g., through tubes of the heat exchanger 222). The furnace system 220 further includes a valve 238 (e.g., a fuel valve) configured to control a flow rate of fuel 232 directed to the burner 230 and therefore control a rate at which the combustion products 226 are produced by the burner 230 and directed through the heat exchanger 222. In some embodiments, the valve 238 may be operated to control an amount of fuel 232 in an air-fuel mixture generated by the burner 230, thereby enabling control of an amount of heat generated via the combustion products 226 for transfer to the air flow 224. Thus, operation of the valve 238 may be controlled to adjust a temperature of the supply air flow 228 generated by the furnace system 220.

The HVAC system 100 also includes a blower 240 (e.g., fan) configured to force the air flow 224 across the heat exchanger 222 and/or to deliver the supply air flow 228 to a space serviced by the furnace system 220 to heat the space. In some embodiments, the blower 240 is a component of the furnace system 220 (e.g., disposed within a housing of the furnace system 220). In other embodiments, the blower 240 may be a component of the HVAC system 100 (e.g., air handling unit, rooftop unit, etc.) having the furnace system 220. The blower 240 may be driven into rotation by a motor 242, and operation of the motor 242 may be controlled by a VSD 244 (e.g., fourth VSD, furnace VSD). As similarly discussed above, the VSD 244 may enable operation of the motor 242 and the blower 240 at variable speed to thereby enable adjustment of a flow rate of the air flow 224 across the heat exchanger 222 and/or a flow rate of the supply air flow 228 directed to the space serviced by the furnace system 220.

As mentioned above, the furnace system 220 also includes an embodiment of the control system 150, which may include the controller 152 having the processing circuitry 156 and the memory device 158, the thermostat 154, the trip switch 160, the one or more sensors 162, and/or the user device 200. The trip switch 160 may be configured to interrupt operation of the furnace system 220 in response to detection of an operating parameter value of the furnace system 220 that reaches or exceeds an operating parameter trip value (e.g., operational parameter limit, upper limit, trip set point), as similarly discussed above. For example, the trip switch 160 may be configured to detect a temperature of the supply air flow 228 produced by the furnace system 220, a temperature of the heat exchanger 222 (e.g., a heat exchanger coil temperature), or any other suitable operating parameter. Upon detection of an operating parameter value that reaches or exceeds an operating parameter trip value of the trip switch 160, the trip switch 160 may actuate to interrupt and/or suspend operation of the furnace system 220. To this end, the trip switch 160 may be coupled (e.g., communicatively coupled, electrically coupled) to the controller 152, the valve 238, the burner 230, the draft inducer fan 236, the blower 240, and/or any other suitable component of the furnace system 220. Actuation of the trip switch 160 may, for example, cause the valve 238 to close, cause the burner 230 to deactivate (e.g., extinguish a flame), and/or interrupt supply of power to the draft inducer fan 236 and/or the blower 240 (e.g., the VSD 244). Additionally or alternatively, the controller 152 may be configured to detect actuation of the trip switch 160 and, in response, may output a signal to interrupt operation of one or more of the components of the furnace system 220. Actuation of the trip switch 160 may also cause a lockout of the furnace system 220, such that intervention by a technician or other operator is demanded to enable resumed operation of the furnace system 220. Therefore, the furnace system 220 may not operate to condition the air flow 224 and generate the supply air flow 228 to provide to a conditioned space.

Accordingly, as similarly described above, the present techniques include the control system 150 configured to detect one or more operating parameters of the furnace system 220 and to implement remedial or compensatory operations to mitigate actuation of the trip switch 160 in the furnace system 220. Indeed, any or all of the techniques described above may be similarly incorporated with the control system 150 (e.g., the controller 152) of the furnace system 220 to mitigate actuation of the trip switch 160 and avoid operational interruptions of the furnace system 220. For example, one or more of the sensors 162 may be configured to detect a temperature of the supply air flow 228 produced by the furnace system 220. That is, one of the sensors 162 may be configured to detect a value the same operating parameter that is detected by the trip switch 160. In other embodiments, one or more of the sensors 162 may be configured to detect another operating parameter of the furnace system 220.

To mitigate actuation of the trip switch 160, the controller 152 may be configured to determine whether a supply air flow temperature value detected by one of the sensors 162 reaches or exceeds a threshold value (e.g., first threshold value) of the supply air flow temperature, where the threshold value is less than the trip value or operating parameter limit value of the supply air flow temperature that causes the trip switch 160 to actuate. The threshold value may be any suitable value that is less than the trip value of the trip switch 160 by any suitable amount or magnitude (e.g., by a safety margin). In some embodiments, the threshold value may be stored in the memory device 158 and may be referenced by the controller 152 during execution of the techniques described herein. The controller 152 may be configured to compare the detected value of the supply air flow temperature (e.g., operating parameter) with multiple threshold values (e.g., supply air flow temperature values, threshold values stored in the memory device 158), where each threshold value is less than the trip value or supply air flow temperature limit value that causes the trip switch 160 to actuate and interrupt operation of the furnace system 220. In some embodiments, the controller 152 may receive multiple detected values of the operating parameter (e.g., supply air flow temperature) from the sensor 162 and may determine a rate of change (e.g., toward the trip value) of the operating parameter value.

As similarly discussed above, in response to a determination that the detected supply air flow temperature value exceeds one or more corresponding threshold values, the controller 152 may determine a desired remedial control operation of the furnace system 220 to mitigate actuation of the trip switch 160. Additionally or alternatively, the controller 152 may determine a desired remedial control operation of the furnace system 220 based on a determined rate of change of the operating parameter value (e.g., exceeding a threshold rate of change). Remedial control operations implemented by the controller 152 of the furnace system 220 may include adjusting a speed of the blower 240, adjusting a speed of the draft inducer fan 236, adjusting an operation of the burner 230, and/or adjusting a position of the valve 238.

For example, the controller 152 may initially determine, select, and/or implement a remedial operation (e.g., first remedial operation) including increasing a speed of the blower 240 to increase a flow rate of the air flow 224 directed across the heat exchanger 222 in response to a determination that a detected supply air flow temperature value exceeds a supply air flow temperature threshold value, such as a lower threshold value (e.g., first threshold value). To this end, the controller 152 may be communicatively coupled to the VSD 244 configured to drive operation of the motor 242 associated with the blower 240. By increasing a speed of the blower 240, heat transfer between the combustion products 226 and the air flow 224 may be reduced, thereby reducing the supply air flow temperature (e.g., below the first threshold value).

Additionally or alternatively, the controller 152 may implement another remedial operation in response to a determination that a detected supply air flow temperature value exceeds one or more corresponding threshold values. For example, in response to a determination that the detected supply air flow temperature value exceeds another supply air flow temperature threshold value, such as an upper threshold value (e.g., second threshold value) that is greater than the lower threshold value, the controller 152 may execute an additional or alternative remedial operation (e.g., second remedial operation), such as decreasing a flow rate of the fuel 232 supplied to the burner 230. For example, the controller 152 may adjust a position of the valve 238 (e.g., reduce an opening of the valve 238, adjust toward a closed position) to reduce the flow rate of the fuel 232 supplied to the burner 230. In this way, an amount and/or a temperature of the combustion products 226 directed through the heat exchanger 222 may be reduced, which may cause a reduction in heat transfer from the combustion products 226 to the air flow 224 and thereby cause a reduction in the supply air flow temperature. Thus, in some embodiments, the controller 152 may increase a speed of the blower 240 as a first or initial remedial operation (e.g., in response to a detected value of the operating parameter exceeding a first threshold value) and may adjust a flow rate of the fuel 232 via positional adjustment of the valve 238 as a second remedial operation (e.g., in response to a detected value of the operating parameter exceeding a second threshold value that is greater than the first threshold value). Alternatively, the controller 152 may be configured to initially adjust operation of both the blower 240 and the valve 238 (e.g., simultaneously).

As similarly discussed above, the controller 152 may determine which of one or more remedial operations to execute and/or a manner (e.g., a sequential order) in which to execute the one or more remedial operations based on a magnitude of the operating parameter (e.g., supply air flow temperature) value relative to other operating parameter values (e.g., relative to one or more operating parameter threshold values, relative to an operating parameter trip value). For example, the controller 152 may determine a magnitude of a speed increase of the blower 240 based on an amount by which the supply air flow temperature value exceeds a particular threshold value and/or based on an amount by which the detected supply air flow temperature value is below the supply air flow temperature trip value. Similarly, the controller 152 may determine a magnitude of adjustment (e.g., positional adjustment, decrease) of the valve 238 based on an amount by which the detected supply air flow temperature value exceeds a particular threshold value (e.g., of a plurality of threshold values) and/or based on an amount by which the detected supply air flow temperature value is below the supply air flow temperature trip value. Additionally or alternatively, a time period during which the remedial operation is implemented may be based on such determined magnitudes. In some embodiments, particular operating adjustments (e.g., adjustment values, blower speed adjustment values, valve position adjustment values, time durations for operating adjustments) may be associated with corresponding supply air flow temperature values (e.g., detected supply air flow temperature values). The correlations between such corresponding adjustments and values may be stored in the memory device 158 and may be referenced by the controller 152 during execution of the techniques described herein.

During execution of one or more of the remedial operations, the controller 152 may continue to receive data and/or feedback from the sensors 162 and may iteratively or continually adjust implementation of the remedial operations (e.g., adjust a speed of the blower 240, adjust a position of the valve 238 to adjust flow of the fuel 232 to the burner 230) to maintain the operating parameter (e.g., supply air flow temperature) below the corresponding operating parameter trip value. In this manner, actuation of the trip switch 160 may be avoided, continued operation of the furnace system 220 may be achieved, and operational integrity (e.g., protection) of the components of the furnace system 220 may be maintained.

As set forth above, embodiments of the present disclosure may provide one or more technical effects useful for operating HVAC systems, such as HVAC systems having a vapor compression system and/or a furnace system, to avoid and/or mitigate operational conditions that may otherwise cause operational interruptions of the HVAC system. In particular, the disclosed techniques include implementing remedial or compensatory operations to mitigate actuation of a trip switch that may cause an operational interruption (e.g., shut down, lockout) of the HVAC system. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heating, ventilation, and air conditioning (HVAC) system, comprising:

a heat exchanger configured to receive a working fluid and place the working fluid in a heat exchange relationship with an air flow directed across the heat exchanger;

a trip switch configured to detect an operating parameter of the HVAC system, wherein the trip switch is configured to interrupt operation of the HVAC system in response to detection of a first value of the operating parameter greater than an operating parameter limit value;

a sensor configured to detect the operating parameter of the HVAC system; and a controller communicatively coupled to the sensor, wherein the controller is configured to:

receive data indicative of a second value of the operating parameter;

compare the second value of the operating parameter to a threshold value of the operating parameter, wherein the threshold value is less than the operating parameter limit value; and adjust operation of the HVAC system in response to a determination that the second value of the operating parameter is greater than the threshold value.

2. The HVAC system of claim 1, wherein the heat exchanger is an outdoor heat exchanger, the operating parameter is a discharge pressure or a discharge temperature of the working fluid, and the controller is configured to adjust operation of a fan configured to direct the air flow across the outdoor heat exchanger in response to the determination that the second value of the operating parameter is greater than the threshold value.

3. The HVAC system of claim 2, wherein the controller is configured to increase a speed of the fan in response to the determination that the second value of the operating parameter is greater than the threshold value.

4. The HVAC system of claim 1, comprising a compressor configured to direct the working fluid through the heat exchanger, wherein the operating parameter is a pressure or a temperature of the working fluid discharged by the compressor, and the controller is configured to adjust operation of the compressor in response to the determination that the second value of the operating parameter is greater than the threshold value.

5. The HVAC system of claim 4, wherein the controller is configured to decrease a speed of the compressor in response to the determination that the second value of the operating parameter is greater than the threshold value.

6. The HVAC system of claim 1, comprising a compressor configured to direct the working fluid through the heat exchanger, wherein the operating parameter is a pressure or a temperature of the working fluid discharged by the compressor; and a fan configured to direct the air flow across the heat exchanger, wherein the heat exchanger is an outdoor heat exchanger, wherein the threshold value is a first threshold value, and the controller is configured to:

compare the second value of the operating parameter to a second threshold value of the operating parameter, wherein the second threshold value is less than the operating parameter limit value and is greater than the first threshold value.

7. The HVAC system of claim 6, wherein the controller is configured to:

adjust operation of the fan in response to the determination that the second value of the operating parameter is greater than the first threshold value and a determination that the second value is less than the second threshold value; and adjust operation of the compressor in response to a determination that the second value of the operating parameter is greater than the second threshold value.

8. The HVAC system of claim 7, wherein the controller is configured to:

increase a speed of the fan in response to the determination that the second value of the operating parameter is greater than the first threshold value and the determination that the second value is less than the second threshold value; and decrease a speed of the compressor in response to the determination that the second value of the operating parameter is greater than the second threshold value.

9. The HVAC system of claim 1, comprising a furnace system, wherein the furnace system comprises the heat exchanger, the working fluid comprises combustion products, the air flow is a supply air flow, and the operating parameter is a temperature of the supply air flow.

10. HVAC system of claim 9, wherein the controller is configured to adjust operation of a blower configured to direct the air flow across the heat exchanger in response to the determination that the second value of the operating parameter is greater than the threshold value.

11. The HVAC system of claim 10, wherein the controller is configured to increase a speed of the blower in response to the determination that the second value of the operating parameter is greater than the threshold value.

12. The HVAC system of claim 9, wherein the furnace system comprises a valve configured to regulate a flow rate of fuel supplied to a burner of the furnace system, and the controller is configured to adjust a position of the valve in response to the determination that the second value of the operating parameter is greater than the threshold value.

13. The HVAC system of claim 12, wherein the controller is configured to adjust the position of the valve toward a closed position to decrease the flow rate of fuel supplied to the burner in response to the determination that the second value of the operating parameter is greater than the threshold value.

14. A control system for a heating, ventilation, and air conditioning (HVAC) system, wherein the control system comprises:

a sensor configured to detect an operating parameter of the HVAC system;

processing circuitry; and a memory comprising instructions that, when executed by the processing circuitry, cause the processing circuitry to:

receive data indicative of a value of the operating parameter from the sensor;

compare the value of the operating parameter to a threshold value of the operating parameter, wherein the threshold value is different from a limit value of the operating parameter that causes a trip switch of the HVAC system to actuate and interrupt operation of the HVAC system; and adjust operation of the HVAC system in response to a determination that the value of the operating parameter exceeds the threshold value.

15. The control system of claim 14, wherein the operating parameter is a discharge pressure of a working fluid directed through a working fluid circuit, a suction pressure of the working fluid directed through the working fluid circuit, a discharge temperature of the working fluid directed through the working fluid circuit, or a suction temperature of the working fluid directed through the working fluid circuit, and wherein the instructions, when executed by the processing circuitry, cause the processing circuitry to:

adjust operation of a compressor of the working fluid circuit in response to the determination that the value of the operating parameter exceeds the threshold value;

adjust operation of a fan configured to direct an air flow across a heat exchanger of the working fluid circuit in response to the determination that the value of the operating parameter exceeds the threshold value; or both.

16. The control system of claim 14, wherein the operating parameter is a temperature of a supply air flow directed through the HVAC system, and wherein the instructions, when executed by the processing circuitry, cause the processing circuitry to:

adjust operation of a fan configured to direct the supply air flow through a furnace of the HVAC system in response to the determination that the value of the operating parameter exceeds the threshold value;

adjust a position of a valve configured to direct a flow of fuel to the furnace in response to the determination that the value of the operating parameter exceeds the threshold value; or both.

17. The control system of claim 14, wherein the instructions, when executed by the processing circuitry, cause the processing circuitry to output a notification to a user device in response to adjusted operation of the HVAC system caused by the determination that the value of the operating parameter exceeds the threshold value.

18. The control system of claim 14, wherein the instructions, when executed by the processing circuitry, cause the processing circuitry to override a signal received from a thermostat of the HVAC system to adjust operation of the HVAC system in response to the determination that the value of the operating parameter exceeds the threshold value.

19. A heating, ventilation, and air conditioning (HVAC) system, comprising:

a heat exchanger configured to receive a working fluid and place the working fluid in a heat exchange relationship with an air flow directed across the heat exchanger;

a fan configured to direct the air flow across the heat exchanger;

a trip switch configured to detect an operating parameter of the HVAC system, wherein the trip switch is configured to interrupt operation of the HVAC system in response to detection of a first value of the operating parameter greater than an operating parameter limit value; and a controller configured to:

receive data from a sensor indicative of a second value of the operating parameter;

compare the second value of the operating parameter to a threshold value of the operating parameter, wherein the threshold value is less than the operating parameter limit value; and adjust operation of the fan in response to a determination that the second value of the operating parameter is greater than the threshold value.

20. The HVAC system of claim 19, wherein:

the heat exchanger is an outdoor heat exchanger, and the air flow is an ambient air flow; or the heat exchanger is a furnace, and the air flow is a supply air flow.

* * * * *